US009004881B2

(12) United States Patent
Simmons et al.

(10) Patent No.: US 9,004,881 B2
(45) Date of Patent: Apr. 14, 2015

(54) MODULAR FLUID-DRIVEN DIAPHRAGM PUMP AND RELATED METHODS

(75) Inventors: Tom M. Simmons, Kamas, UT (US); John M. Simmons, Marion, UT (US); David M. Simmons, Francis, UT (US); Bruce Johnson, West Valley, UT (US)

(73) Assignee: Simmons Development, LLC, Salt Lake City, UT (US)

( * ) Notice: Subject to any disclaimer, the term of this patent is extended or adjusted under 35 U.S.C. 154(b) by 256 days.

(21) Appl. No.: 13/452,077

(22) Filed: Apr. 20, 2012

(65) Prior Publication Data

US 2013/0280102 A1 Oct. 24, 2013

(51) Int. Cl.

| | |
|---|---|
| ***F04B 45/00*** | (2006.01) |
| ***F04B 47/08*** | (2006.01) |
| ***F04B 23/04*** | (2006.01) |
| ***F04B 7/04*** | (2006.01) |

(Continued)

(52) U.S. Cl.

CPC ..... *F04B 43/0736* (2013.01); *Y10T 29/49236* (2015.01)

(58) Field of Classification Search

CPC ..... F04B 9/111; F04B 9/115; F04B 23/06; F04B 43/02; F04B 43/023; F04B 43/025; F04B 43/06; F04B 43/067; F04B 43/073; F04B 43/113; F04B 49/00; F04B 49/002; F04B 2233/0903; F04B 43/026; F04B 43/0736; F04B 9/113; F04B 9/131; F04B 9/1315; F04B 9/133; F04B 41/14; F04B 49/12

USPC ..... 417/375, 394, 395, 426, 427, 456, 457, 417/758, 53, 49, 493, 554, 534, 535, 536, 417/63, 429

See application file for complete search history.

(56) References Cited

U.S. PATENT DOCUMENTS

| | | | | |
|---|---|---|---|---|
| 2,296,647 | A * | 9/1942 | McCormick | 91/306 |
| 4,123,204 | A * | 10/1978 | Scholle | 417/393 |
| 5,370,507 | A | 12/1994 | Dunn et al. | |

(Continued)

FOREIGN PATENT DOCUMENTS

| | | |
|---|---|---|
| JP | 05-288159 | 11/1993 |
| JP | 2003-172267 | 6/2003 |

OTHER PUBLICATIONS

Search Report for International Application No. PCT/US2013/037294, dated Jul. 22, 2013, 3 pages.

(Continued)

*Primary Examiner* — Bryan Lettman
*Assistant Examiner* — Timothy P Solak
(74) *Attorney, Agent, or Firm* — TraskBritt

(57) ABSTRACT

A fluid pump includes a pump body enclosing a first cavity and a second cavity, a first flexible member disposed within the first cavity, a second flexible member disposed within the second cavity, and a drive shaft extending between and attached to each of the first flexible member and the second flexible member. The drive shaft is configured to slide back and forth within the pump body. The pump also includes a first shift valve and a second shift valve disposed between the first flexible member and the second flexible member, operatively coupled to deliver a drive fluid to drive fluid chambers in alternating sequence. Some fluid pumps disclosed herein include a housing defining a modular-receiving cavity and a modular insert secured within the modular-receiving cavity by an interference fit. Methods of manufacturing and using fluid pumps are also disclosed.

22 Claims, 12 Drawing Sheets

(51) Int. Cl.
*F04B 43/12* (2006.01)
*F04B 43/073* (2006.01)

(56) References Cited

U.S. PATENT DOCUMENTS 5,558,506 A 9/1996 Simmons et al.
5,616,005 A 4/1997 Whitehead
5,640,995 A * 6/1997 Packard et al. ..... 137/597
5,893,707 A 4/1999 Simmons et al.
6,071,090 A * 6/2000 Miki et al. ..... 417/395
6,106,246 A 8/2000 Steck et al.
6,230,609 B1 * 5/2001 Bender et al. ..... 92/99
6,295,918 B1 10/2001 Simmons et al.
6,435,845 B1 * 8/2002 Kennedy et al. ..... 417/395
6,685,443 B2 2/2004 Simmons et al.
7,458,309 B2 12/2008 Simmons et al.
2002/0076340 A1 * 6/2002 Yamada ..... 417/393
2010/0178182 A1 7/2010 Simmons et al.
2010/0247334 A1 * 9/2010 Simmons et al. ..... 417/53

OTHER PUBLICATIONS

Written Opinion for International Application No. PCT/US2013/037294, dated Jul. 22, 2013, 5 pages.

* cited by examiner

MODULAR FLUID-DRIVEN DIAPHRAGM PUMP AND RELATED METHODS

FIELD

The present disclosure relates generally to reciprocating fluid pumps, and to methods of making and using such pumps.

BACKGROUND

Reciprocating fluid pumps are used in many industries. Reciprocating fluid pumps generally include two fluid chambers in a pump body. A reciprocating piston or shaft is driven back and forth within the pump body. As the reciprocating piston moves in one direction, fluid may be drawn into a first fluid chamber of the two fluid chambers and expelled from a second chamber of the two fluid chambers in the pump body. As the reciprocating piston moves in an opposite direction, fluid is expelled from the first fluid chamber and fluid is drawn into the second fluid chamber. A chamber inlet and a chamber outlet may be provided in fluid communication with the first fluid chamber, and another chamber inlet and another chamber outlet may be provided in fluid communication with the second fluid chamber. The chamber inlets to the first and second fluid chambers may be in fluid communication with a common single pump inlet, and the chamber outlets from the first and second fluid chambers may be in fluid communication with a common single pump outlet, such that fluid may be drawn into the pump body through the single pump inlet from a single fluid source, and fluid may be expelled from the pump through the single pump outlet. Check valves may be provided at the chamber inlet and outlet of each of the fluid chambers to ensure that fluid can only flow into the fluid chambers through the chamber inlets, and fluid can only flow out of the fluid chambers through the chamber outlets.

Examples of such reciprocating fluid pumps are disclosed in, for example, U.S. Pat. No. 5,370,507, which issued Dec. 6, 1994 to Dunn et al.; U.S. Pat. No. 5,558,506, which issued Sep. 24, 1996 to Simmons et al.; U.S. Pat. No. 5,893,707, which issued Apr. 13, 1999 to Simmons et al.; U.S. Pat. No. 6,106,246, which issued Aug. 22, 2000 to Steck et al.; U.S. Pat. No. 6,295,918, which issued Oct. 2, 2001 to Simmons et al.; U.S. Pat. No. 6,685,443, which issued Feb. 3, 2004 to Simmons et al.; and U.S. Pat. No. 7,458,309, which issued Dec. 2, 2008 to Simmons et al.; the disclosures of each of which are incorporated herein in their entireties by this reference.

There remains a need in the art for improved reciprocating fluid pumps and methods of making and using such pumps.

BRIEF SUMMARY

In some embodiments, the present disclosure includes a fluid pump. The fluid pump may include a pump body enclosing a first cavity and a second cavity, a first flexible member disposed within the first cavity and defining a first subject fluid chamber and a first drive fluid chamber within the first cavity, a second flexible member disposed within the second cavity and defining a second subject fluid chamber and a second drive fluid chamber within the second cavity, and a drive shaft extending between and attached to each of the first flexible member and the second flexible member. The drive shaft is configured to slide back and forth within the pump body. The fluid pump also includes a first shift valve disposed between the first flexible member and the second flexible member, and a second shift valve disposed between the first flexible member and the second flexible member. The first shift valve is configured to move in response to movement of the first flexible member, and the second shift valve is configured to move in response to movement of the second flexible member. The first shift valve and the second shift valve are operatively coupled to deliver a drive fluid to the first drive fluid chamber and the second drive fluid chamber in alternating sequence.

Additional embodiments of fluid pumps of the present disclosure include a pump body having a modular-receiving cavity therein, and a modular insert secured within the modular-receiving cavity by an interference fit. The pump body and the modular insert together may define at least a portion of at least one fluid passageway extending around the modular insert at an interface between the modular insert and the pump body.

A method for manufacturing a fluid pump may include dividing a first cavity in a pump body with a first flexible member to define a first subject fluid chamber and a first drive fluid chamber within the first cavity. Similarly, the method may include dividing a second cavity in the pump body with a second flexible member to define a second subject fluid chamber and a second drive fluid chamber within the second cavity. The first flexible member and the second flexible member may be connected with a drive shaft extending at least partially through the pump body. A first shift valve may be positioned within the pump body between the first flexible member and the second flexible member beside the drive shaft. A second shift valve may be positioned within the pump body between the first flexible member and the second flexible member beside the drive shaft and the first shift valve.

The method may also include configuring the first shift valve to move from a first position to a second position thereof responsive to mechanical force when the drive shaft reaches an end of a stroke in a first direction. Movement of the first shift valve from the first position to the second position thereof may cause a pressure of the drive fluid to move the second shift valve from a second position to a first position thereof and switching delivery of the drive fluid from the second drive fluid chamber to the first drive fluid chamber. The method may also include configuring the second shift valve to move from the first position to the second position thereof responsive to mechanical force when the drive shaft reaches an end of a stroke in a second direction. Movement of the second shift valve from the first position to the second position thereof may cause the pressure of the drive fluid to move the first shift valve from the second position to the first position and switching delivery of the drive fluid from the first drive fluid chamber to the second drive fluid chamber.

A method of manufacturing a fluid pump may include forming a modular-receiving cavity within a housing, forming a plurality of recesses within the housing, disposing an insert within the modular-receiving cavity, and disposing a drive shaft within the insert.

Methods of pumping fluid may include moving a drive shaft, a first flexible member attached to a first end of the drive shaft, and a second flexible member attached to an opposite, second end of the drive shaft in a first direction in a pump body to expel fluid from a first subject fluid chamber adjacent the first flexible member and draw fluid into a second subject fluid chamber adjacent the second flexible member. The methods may further include moving a first shift valve located within the pump body between the first flexible member and the second flexible member beside the drive shaft in response to movement of the second flexible member; moving the drive shaft, the first flexible member, and the second flexible member in a second direction opposite the first direction to expel fluid from the second subject fluid chamber and draw fluid into the first subject fluid chamber; and moving a second shift valve located within the pump body between the first flexible member and the second flexible member beside the drive shaft in response to movement of the first flexible member.

BRIEF DESCRIPTION OF THE DRAWINGS

While the specification concludes with claims particularly pointing out and distinctly claiming what are regarded as embodiments of the present disclosure, the advantages of embodiments of the disclosure may be more readily ascertained from the description of some embodiments of the disclosure when read in conjunction with the accompanying drawings, in which:

DETAILED DESCRIPTION

The illustrations presented herein may not be actual views of any particular fluid system or component of a fluid pump or pump system, but are merely idealized representations which are employed to describe embodiments of the present disclosure. Elements common between figures may retain the same numerical designation.

As used herein, the term "subject fluid" means and includes any fluid to be pumped using a fluid pump as described herein.

As used herein, the term "drive fluid" means and includes any fluid used to drive a pumping mechanism of a fluid pump as described herein. Drive fluids include air and other gases.

Figure 1:
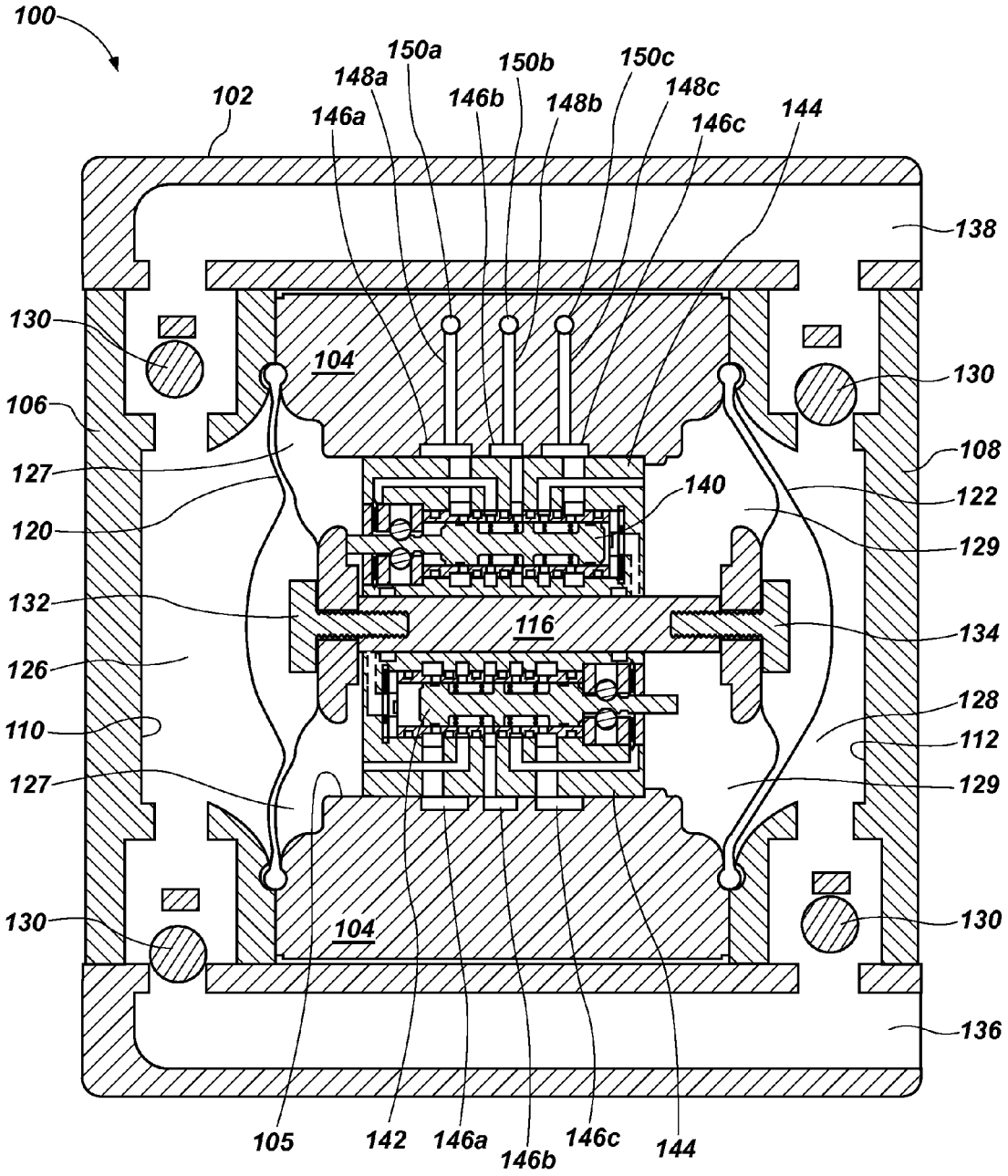
FIG. 1 is a simplified cross-sectional schematic diagram of an embodiment of a fluid pump of the present disclosure and illustrates components of the fluid pump at one point in a stroke of the fluid pump.

FIG. 1 illustrates an embodiment of a fluid pump 100 of the present disclosure. In some embodiments, the fluid pump 100 is configured to pump a subject fluid, such as a liquid (e.g., water, oil, acid, etc.), using a pressurized drive fluid, such as compressed gas (e.g., air). Thus, in some embodiments, the fluid pump 100 may comprise a pneumatically operated liquid pump. Furthermore, as described in further detail below, the fluid pump 100 may comprise a reciprocating pump.

The fluid pump 100 includes a pump body 102 or housing, which may comprise a central body 104, a first end body 106, and a second end body 108. The central body 104 may have a central cavity 105 formed therein (see also FIG. 11). The central body 104, the first end body 106, and the second end body 108 may be sized, shaped, and otherwise configured to form a first cavity 110 and a second cavity 112 within the pump body 102 when the end bodies 106, 108 are attached to the central body 104. For example, a first cavity 110 may be formed between, and defined by, inner surfaces of each of the central body 104 and the first end body 106, and a second cavity 112 may be formed between, and defined by, inner surfaces of each of the central body 104 and the second end body 108.

A drive shaft 116 may be positioned within the central body 104, such that the drive shaft 116 extends through the central body 104 between the first cavity 110 and the second cavity 112. A first end of the drive shaft 116 may be positioned within the first cavity 110, and an opposite second end of the drive shaft 116 may be positioned within the second cavity 112. The drive shaft 116 is configured to slide back and forth within a bore in the central body 104. Furthermore, one or more fluid-tight seals 118 (see FIG. 3) may be provided between the drive shaft 116 and the central body 104, such that fluid is prevented from flowing through any space between the drive shaft 116 and the central body 104.

A first flexible member 120 may be disposed within the first cavity 110, and a second flexible member 122 may be disposed within the second cavity 112. The flexible members 120, 122 may comprise, for example, diaphragms or bellows comprised of a flexible polymer material (e.g., an elastomer or a thermoplastic material). In some embodiments, the flexible members 120, 122 may comprise helical bellows as disclosed in U.S. Patent Application Publication No. 2010/0178182, published Jul. 15, 2010, and entitled "Helical Bellows, Pump Including Same and Method of Bellows Fabrication," the disclosure of which is incorporated herein in its entirety by this reference. The first flexible member 120 may divide the first cavity 110 into a first subject fluid chamber 126 on a side of the first flexible member 120 opposite the central body 104 (and proximate the first end body 106) and a first drive fluid chamber 127 on a side of the first flexible member 120 proximate the central body 104 (and opposite the first end body 106). Similarly, the second flexible member 122 may divide the second cavity 112 into a second subject fluid chamber 128 on a side of the second flexible member 122 opposite the central body 104 (and proximate the second end body 108) and a second drive fluid chamber 129 on a side of the second flexible member 122 proximate the central body 104 (and opposite the second end body 108).

A peripheral edge of the first flexible member 120 may be disposed between the first end body 106 and the central body 104, and a fluid-tight seal may be provided between the first end body 106 and the central body 104 across the peripheral edge portion of the first flexible member 120. The first end of the drive shaft 116 may be coupled to a portion of the first flexible member 120. In some embodiments, the first end of the drive shaft 116 may extend through an aperture in a central portion of the first flexible member 120, and one or more sealing attachment members 132 (e.g., nuts, screws, washers, seals, etc.) may be provided on the drive shaft 116 on one or both sides of the first flexible member 120 to attach the first flexible member 120 to the first end of the drive shaft 116, and to provide a fluid-tight seal between the drive shaft 116 and the first flexible member 120, such that fluid cannot flow between the first subject fluid chamber 126 and the first drive fluid chamber 127 through any space between the drive shaft 116 and the first flexible member 120.

Similarly, a peripheral edge of the second flexible member 122 may be disposed between the second end body 108 and the central body 104, and a fluid-tight seal may be provided between the second end body 108 and the central body 104 across the peripheral edge portion of the second flexible member 122. The second end of the drive shaft 116 may be coupled to a portion of the second flexible member 122. In some embodiments, the second end of the drive shaft 116 may extend through an aperture in a central portion of the second flexible member 122, and one or more sealing attachment members 134 (e.g., nuts, screws, washers, seals, etc.) may be provided on the drive shaft 116 on one or both sides of the second flexible member 122 to attach the second flexible member 122 to the second end of the drive shaft 116, and to provide a fluid-tight seal between the drive shaft 116 and the second flexible member 122, such that fluid cannot flow between the second subject fluid chamber 128 and the second drive fluid chamber 129 through any space between the drive shaft 116 and the second flexible member 122.

In this configuration, the drive shaft 116 is capable of sliding back and forth within the pump body 102. As the drive shaft 116 moves to the right (from the perspective of FIG. 1), the first flexible member 120 will be caused to move and/or deform such that the volume of the first subject fluid chamber 126 increases and the volume of the first drive fluid chamber 127 decreases, and the second flexible member 122 will be caused to move and/or deform such that the volume of the second subject fluid chamber 128 decreases and the volume of the second drive fluid chamber 129 increases. Conversely, as the drive shaft 116 moves to the left (from the perspective of FIG. 1), the first flexible member 120 will be caused to move and/or deform such that the volume of the first subject fluid chamber 126 decreases and the volume of the first drive fluid chamber 127 increases, and the second flexible member 122 will be caused to move and/or deform such that the volume of the second subject fluid chamber 128 increases and the volume of the second drive fluid chamber 129 increases.

A subject fluid inlet 136 may lead into the first subject fluid chamber 126 and/or the second subject fluid chamber 128. A subject fluid outlet 138 may lead out from the first subject fluid chamber 126 and/or the second subject fluid chamber 128. In some embodiments, the subject fluid inlet 136 and/or the subject fluid outlet 138 may be as described in, for example, previously referenced U.S. Pat. No. 7,458,309, which issued Dec. 2, 2008. The subject fluid inlet 136 and/or the subject fluid outlet 138 may comprise one or more valves, manifolds, fittings, seals, etc. For example, the subject fluid inlet 136 and/or the subject fluid outlet 138 may comprise one-way valves as described in U.S. Patent Application Publication No. 2010/0247334, published Sep. 30, 2010, and entitled "Piston Systems Having a Flow Path Between Piston Chambers, Pumps Including a Flow Path Between Piston Chambers, and Methods of Driving Pumps," the disclosure of which is incorporated herein in its entirety by this reference. Valves 130 may be provided in each of the subject fluid inlets 136 and outlets 138 to limit or prevent subject fluid from flowing out from the subject fluid chambers 126, 128 through the subject fluid inlets 136, and/or to limit or prevent subject fluid being drawn into the subject fluid chambers 126, 128 from the subject fluid outlets 138. For example, the valves 130 may be check valves as disclosed in U.S. Pat. No. 7,458,309.

The subject fluid inlet 136 may lead to both the first subject fluid chamber 126 and the second subject fluid chamber 128, such that fluid may be drawn into the fluid pump 100 through the subject fluid inlet 136 from a single fluid source. Similarly, the subject fluid outlet 138 may be fed from both the first subject fluid chamber 126 and the second subject fluid chamber 128, such that fluid may be expelled from the fluid pump 100 through a single fluid outlet line. In other embodiments, there may be multiple subject fluid inlets (not shown) and/or multiple subject fluid outlets (not shown), each in fluid communication with the first subject fluid chamber 126 and/or the second subject fluid chamber 128.

The first drive fluid chamber 127 may be pressurized with drive fluid, which may push the first flexible member 120 to the left (from the perspective of FIG. 1). As the first flexible member 120 moves to the left, the drive shaft 116 and the second flexible member 122 are pulled to the left. As the drive shaft 116, the first flexible member 120, and the second flexible member 122 move to the left (from the perspective of FIG. 1), any subject fluid within the first subject fluid chamber 126 may be expelled from the first subject fluid chamber 126 through the respective subject fluid outlet 138 leading out from the first subject fluid chamber 126, and subject fluid will be drawn into the second subject fluid chamber 128 through the respective subject fluid inlet 136 leading to the second subject fluid chamber 128.

The second drive fluid chamber 129 may be pressurized with drive fluid, which may push the second flexible member 122 to the right (from the perspective of FIG. 1). As the second flexible member 122 moves to the right, the drive shaft 116 and the first flexible member 120 may be pulled to the right. Thus, any subject fluid within the second subject fluid chamber 128 may be expelled from the second subject fluid chamber 128 through the subject fluid outlet 138 leading out from the second subject fluid chamber 128, and subject fluid may be drawn into the first subject fluid chamber 126 through the subject fluid inlet 136 leading to the first subject fluid chamber 126.

To drive the pumping action of the fluid pump 100, the first drive fluid chamber 127 and the second drive fluid chamber 129 may be pressurized in an alternating manner to cause the drive shaft 116, the first flexible member 120, and the second flexible member 122 to reciprocate back and forth within the pump body 102.

The fluid pump 100 may comprise a shifting mechanism for shifting the flow of pressurized drive fluid back and forth between the first drive fluid chamber 127 and the second drive fluid chamber 129 at the ends of the stroke of the drive shaft 116. The shifting mechanism may comprise, for example, a first shift valve 140 and a second shift valve 142. The first shift valve 140 and the second shift valve 142 may be operatively coupled to deliver a drive fluid to the first drive fluid chamber 127 and the second drive fluid chamber 129 in alternating sequence. The first shift valve 140 and the second shift valve 142 may be disposed within a modular insert 144. The modular insert 144 may be disposed within the central cavity 105 within the central body 104. That is, the central cavity 105 may sized and configured to receive the modular insert 144. Both the modular insert 144 and the central cavity 105 may be generally cylindrical or any other selected shape (e.g., having an oval cross section, a square cross section, etc.). The modular insert 144 may be secured within the central cavity 105 by an interference fit, by screws, or by any other attachment means.

As shown in FIG. 1, the first shift valve 140 and the second shift valve 142 may be disposed within the modular insert 144 (within the central body 104 of the pump body 102) between the first flexible member 120 and the second flexible member 122. The first shift valve 140 and the second shift valve 142 may each comprise elongated bodies oriented generally parallel to the drive shaft 116. The first shift valve 140 and the second shift valve 142 may be generally cylindrical or any other selected shape (e.g., having an oval cross section, a square cross section, etc.). The first shift valve 140 and the second shift valve 142 may be located within the modular insert 144 beside the drive shaft 116. The first shift valve 140 and the second shift valve 142 may be disposed within bores extending through at least a portion of the modular insert 144 between the first drive fluid chamber 127 and the second drive fluid chamber 129.

Each of the first shift valve 140 and the second shift valve 142 may be configured to shift between two positions as the fluid pump 100 operates. The first shift valve 140 is moved from its first position to its second position by mechanical force when the drive shaft 116 reaches an end of a stroke. Movement of the first shift valve 140 from its first position to its second position causes pressure of the drive fluid to move the second shift valve 142 from its second position to its first position, switching delivery of the drive fluid from the second drive fluid chamber 129 to the first drive fluid chamber 128, and beginning an opposite stroke.

At the end of the opposite stroke (i.e., the end of the drive shaft's 116 travel in the opposite direction), the second shift valve 142 is moved from its first position to its second position by mechanical force of the drive shaft 116. Movement of the second shift valve 142 from its first position to its second position causes the pressure of the drive fluid to move the first shift valve 140 from its second position to its first position, switching delivery of the drive fluid from the first drive fluid chamber 128 back to the second drive fluid chamber 129. Thus completes a cycle of the fluid pump 100.

Figure 2:
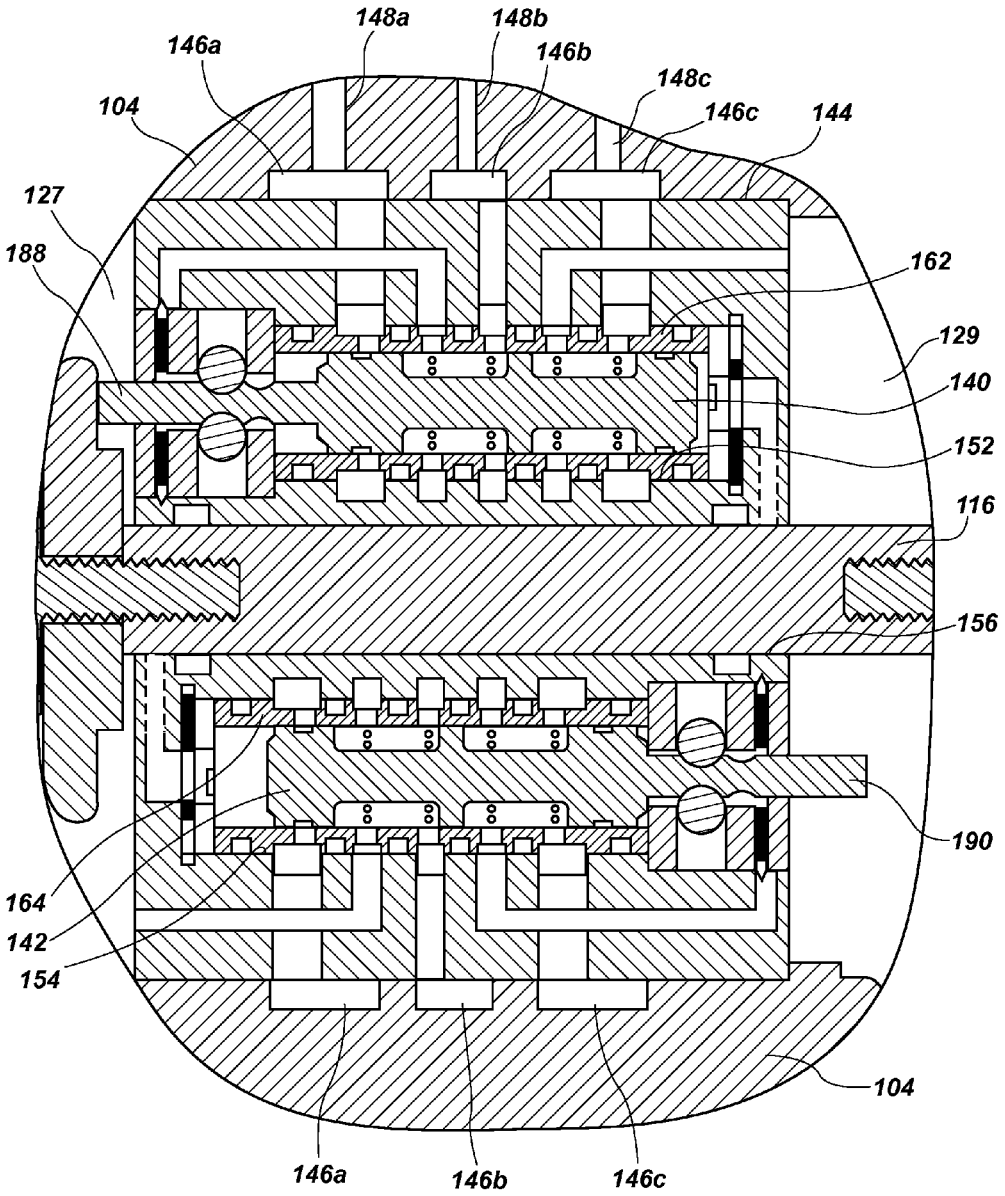
FIG. 2 is an enlarged view of a portion of the fluid pump of FIG. 1 including shift valves within the fluid pump.
Figure 3:
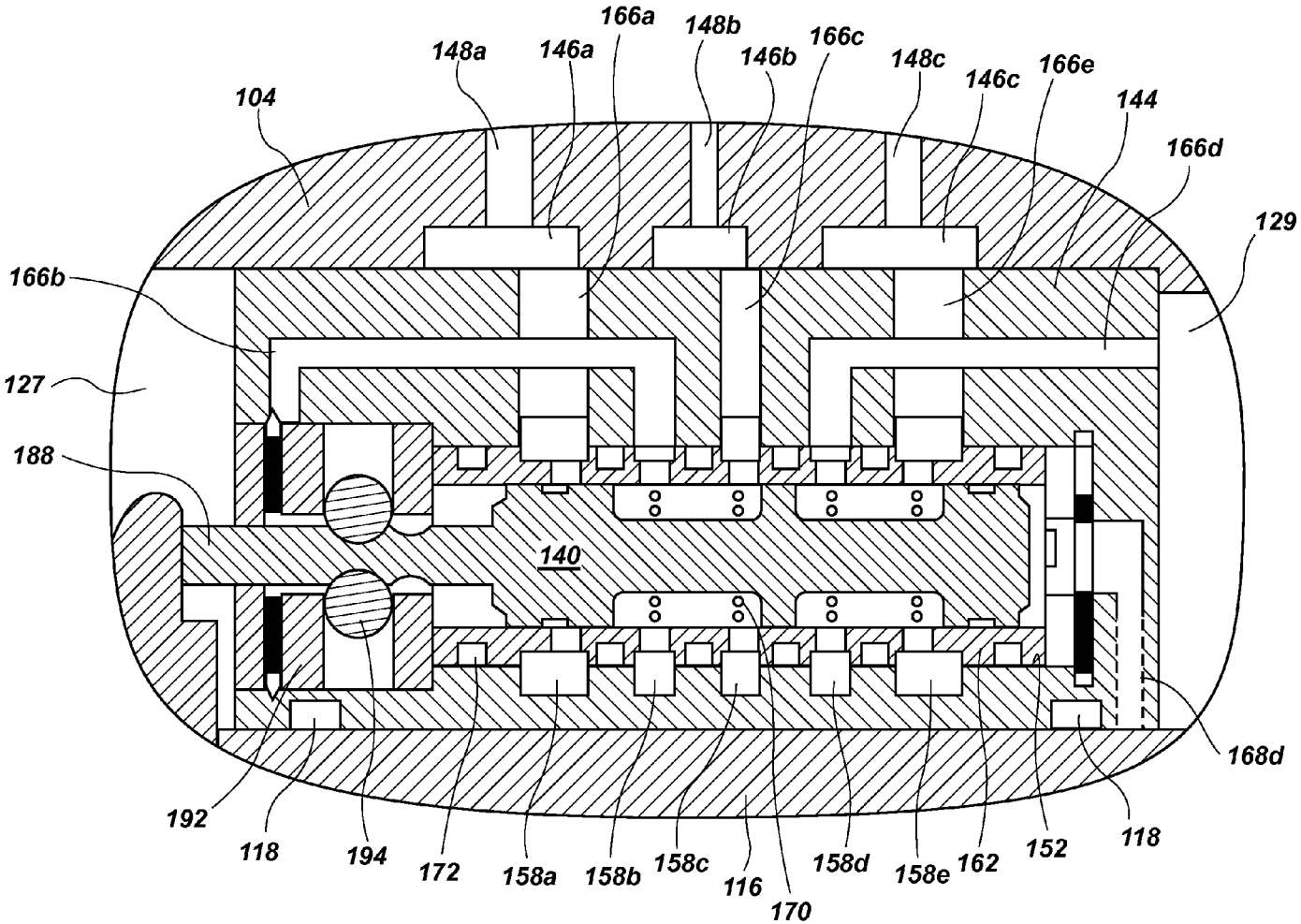
FIG. 3 is a further enlarged view of a portion of the fluid pump of FIG. 1 including a first shift valve within the fluid pump.
Figure 4:
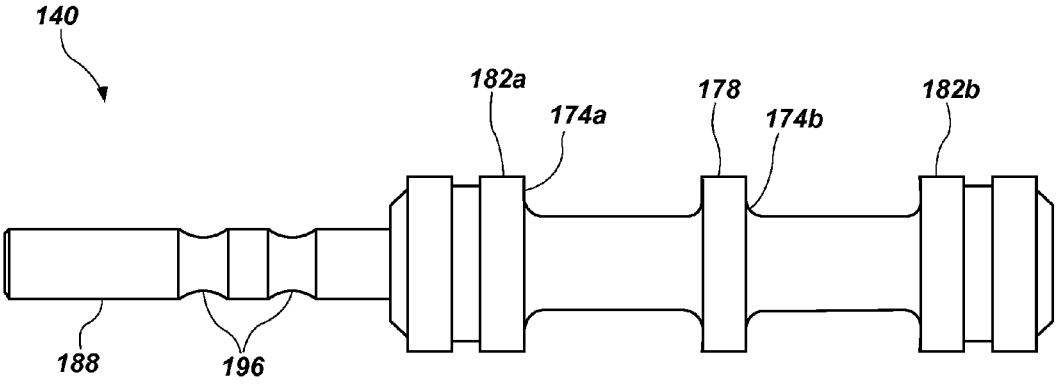
FIG. 4 is an enlarged view of the first shift valve of the fluid pump of FIG. 1.
Figure 6:
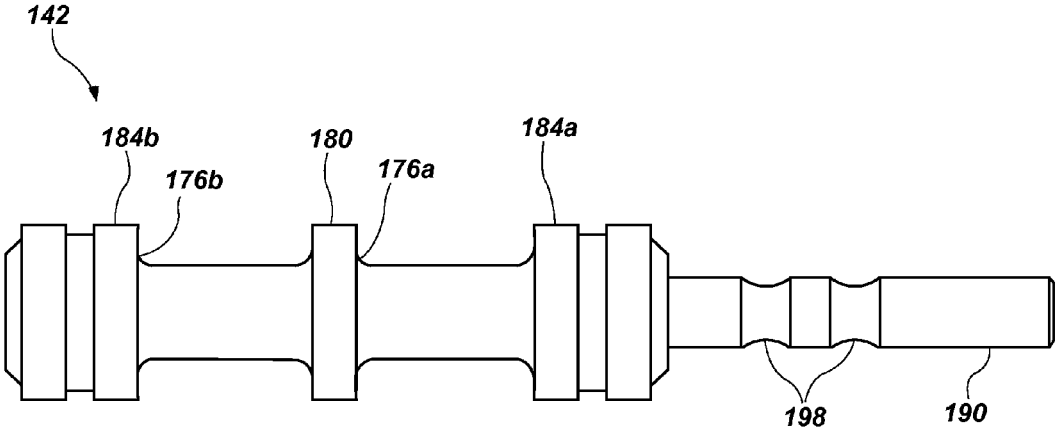
FIG. 6 is an enlarged view of the second shift valve of the fluid pump of FIG. 1.
Figure 5:
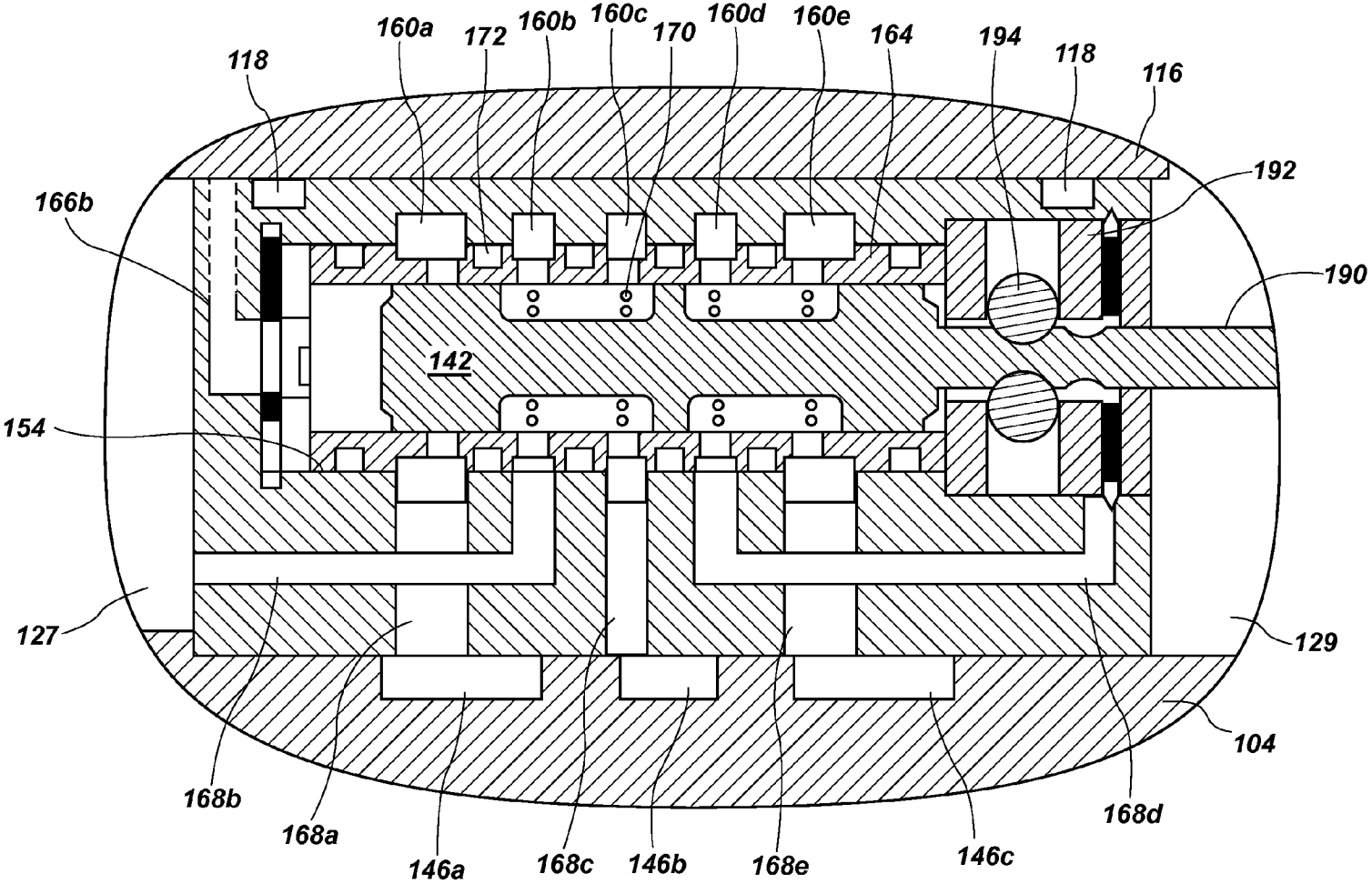
FIG. 5 is a further enlarged view of a portion of the fluid pump of FIG. 1 including a second shift valve within the fluid pump.

FIG. 2 is an enlarged view of a portion of FIG. 1, including the first shift valve 140 and the second shift valve 142 in the modular insert 144. Portions of FIG. 2 are further enlarged and shown in FIGS. 3 through 6. In particular, FIG. 3 shows the first shift valve 140 in the modular insert 144, and FIG. 4 shows the first shift valve 140 alone. FIG. 5 shows the second shift valve 142 in the modular insert 144, and FIG. 6 shows the second shift valve 142 alone. As shown in FIG. 2, recesses 146*a*-146*c* or drive fluid passageways may be provided in a wall of the central body 104 around the cavity 105 therein. The recesses 146*a*-146*c* may be annular in shape, and may be at least partially defined by one or each of the central body 104 and the modular insert 144. That is, the central body 104 and the modular insert 144 may together define at least a portion of the recesses 146*a*-146*c*, and the recesses 146*a*-146*c* may extend at least partially around the modular insert 144 at an interface between the modular insert 144 and the central body 104. For example, recesses 146*a*-146*c* may be machined into the central body 104 before insertion of the modular insert 144. The modular insert 144 may define an inner boundary of one or more of the recesses 146*a*-146*c*. Each of the recesses 146*a*-146*c* may comprise a substantially continuous annular recess that extends around the modular insert 144. Thus, each of the recesses 146*a*-146*c* may be seen in the cross-sectional view of FIG. 2 over and under the modular insert 144 (from the perspective of FIG. 2). One or more of the recesses 146*a*-146*c* may be drive fluid passageways, and may be configured to direct a drive fluid to and from the first shift valve 140 and the second shift valve 142. The recesses 146*a*-146*c* may also each provide a fluid path between a portion of the first shift valve 140 and a portion of the second shift valve 142. Fluid conduits 148*a*-148*c* may lead through the pump body 102 (e.g., through the central body 104 of the pump body 102 (see FIG.1)) to one or more of the recesses 146*a*-146*c*. For example, the fluid conduit 148*b* may be connected to a port 150*b* (FIG. 1), which may in turn be connected to a drive fluid source (e.g., a pressurized fluid). The fluid conduits 148*a*, 148*c* may be connected to ports 150*a*, 150*c* (FIG. 1), which may be exhaust ports (e.g., open to the atmosphere).

The modular insert 144 may itself define one or more cavities. For example, as shown in FIG. 2, the modular insert 144 may have three cavities 152, 154, 156 (see also FIG. 12). The first cavity 152 and the second cavity 154 may be configured to contain the first shift valve 140 and the second shift valve 142, respectively. The third cavity 156 may be configured to contain the drive shaft 116. The three cavities 152, 154, 156 may be substantially cylindrical or have any other selected shape. The three cavities 152, 154, 156 may each have a longitudinal axis oriented at least substantially parallel to longitudinal axes of the other cavities 152, 154, 156. The shift valves 140, 142, and the drive shaft 116 may therefore have longitudinal axes that are substantially parallel to one another.

One or more of the cavities 152, 154, 156 may comprise substantially continuous recesses that extend around a bore. For example, as shown in FIG. 3, recesses 158*a*-158*e* may be provided in a wall of the modular insert 144 around the first cavity 152. The recesses 158*a*-158*e* may be annular or any other selected shape, and may be at least partially defined by the inset 144 and/or a sleeve 162. For example, recesses 158*a*-158*e* may be machined into the modular insert 144 before insertion of the sleeve 162. The sleeve 162 may define an inner boundary of one or more of the recesses 158*a*-158*e*. Each of the recesses 158*a*-158*e* may comprise a substantially continuous recess that extends around the sleeve 162. Thus, each of the recesses 158*a*-158*e* may be seen in the cross-sectional view of FIG. 3 (and in FIG. 12) over and under the sleeve 162 (from the perspective of FIG. 3). One or more of the recesses 158*a*-158*e* may be drive fluid passageways, and may be configured to direct a drive fluid to and from the first shift valve 140. Fluid conduits 166*a*-166*e* may lead through the modular insert 144 to one or more of the recesses 146*a*-146*c*, 158*a*-158*e*. The fluid conduits 166*a*-166*e* are shown as intersecting the plane of view in FIG. 3 to improve clarity of the functions and connections of the fluid conduits 166*a*-166*e*. However, the fluid conduits 166*a*-166*e* may be disposed in any position around the first shift valve 140. The fluid conduit 166*a* may connect recess 158*a* to recess 146*a*. Fluid conduit 166*b* may connect recess 158*b* to an end of the second cavity 154 (see FIG. 5). Fluid conduit 166*c* may connect recess 158*c* to recess 146*b*. Fluid conduit 166*d* may connect recess 158*d* to the second drive fluid chamber 129. Fluid conduit 166*e* may connect recess 158*e* to recess 146*c*.

The sleeve 162 may be generally cylindrical or any other selected shape (e.g., having an oval cross section, a square cross section, etc.). The sleeve 162 may be secured within the first cavity 152 by an interference fit, by screws, or by any other attachment means. One or more holes 170 may be provided through the sleeve 162 in each plane transverse to the longitudinal axis of the first shift valve 140 that is aligned with one of the recesses 158*a*-158*e*. Thus, fluid communication may be provided between the interior of the sleeve 162 and each of the recesses 158*a*-158*e* through the holes 170. Furthermore, a plurality of sealing members 172 (e.g., O-rings) may be provided between the outer cylindrical surface of the sleeve 162 and the adjacent wall of the modular insert 144 within the bore in which the sleeve 162 is disposed, such as to eliminate fluid communication between any of the recesses 158*a*-158*e* through any space between the sleeve 162 and the modular insert 144. The first shift valve 140 may slide freely back and forth within the sleeve 162.

As shown in FIG. 4, the first shift valve 140 may comprise a first recess 174*a* in the outer surface of the first shift valve 140 and a second recess 174*b* in the outer surface of the first shift valve 140. The first recess 174*a* and the second recess 174*b* may be separated by a central ridge 178 on the outer surface of the first shift valve 140. Furthermore, a first end ridge 182*a* may be provided on the outer surface of the first shift valve 140 on a longitudinal side of the first recess 174*a* opposite the central ridge 178, and a second end ridge 182*b* may be provided on the outer surface of the first shift valve 140 on a longitudinal side of the second recess 174*b* opposite the central ridge 178.

Each of the first recess 174*a* and the second recess 174*b* may have a length (i.e., a dimension measured generally parallel to the longitudinal axis of the first shift valve 140) that is long enough to at least partially longitudinally overlap two adjacent recesses of the recesses 158*a*-158*e*. For example, when the first shift valve 140 is in the position shown in FIG. 3, the first recess 174*a* extends to and at least partially overlaps each of the recesses 158*b* and 158*c*, and the second recess 174*b* extends to and at least partially overlaps each of the recesses 158*d* and 158*e*. In this configuration, fluid communication is provided between the drive fluid source through the port 150*b* (FIG. 1) and the end of the second cavity 154 (see FIG. 5) via conduits 148*b*, 166*b*, 166*c*, recesses 146*b*, 158*b*, 158*c*, 174*a*, and the holes 170 in the sleeve 162. Fluid communication is also provided between the port 150*c* (FIG. 1) and the second drive fluid chamber 129 via conduits 148*c*, 166*d*, 166*e*, recesses 146*c*, 158*d*, 158*e*, 174*b*, and the holes 170 in the sleeve 162. The significance of the fluid communication will become apparent below, in the description of the operation of the fluid pump 100.

As shown in FIGS. 2 through 4, an elongated extension 188 may be provided on a first end of the first shift valve 140 that extends at least partially into the first drive fluid chamber 127. The elongated extension 188 may be located and configured such that at least one of the first flexible member 120 and a sealing attachment member 132 (FIG. 1) abuts against the end of the elongated extension 188 of the first shift valve 140 when the first flexible member 120 moves a certain distance to the right (from the perspective of FIG. 1). When at least one of the first flexible member 120 and a sealing attachment member 132 abuts against the end of the elongated extension 188 of the first shift valve 140, the first shift valve 140 may be forced to the right, redistributing the flow of drive fluid around the first shift valve 140, signaling the end of a stroke of the drive shaft 116, and causing the drive shaft 116, the first flexible member 120, and the second flexible member 122 to begin moving to the left, as discussed in further detail below.

Figure 7:
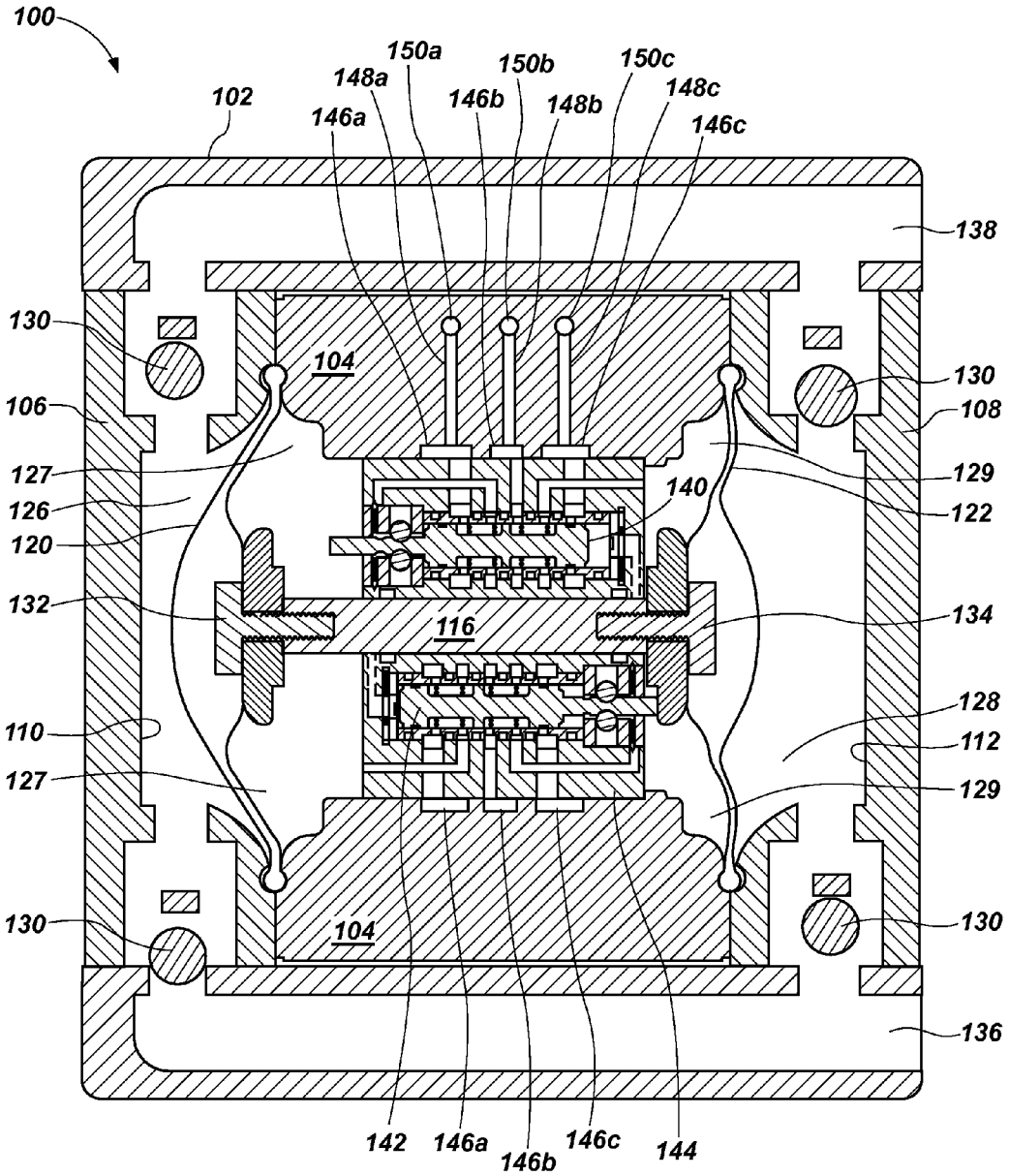
FIG. 7 is another simplified cross-sectional schematic diagram of the fluid pump of FIG. 1, and illustrates components of the fluid pump in a position at another point in the stroke of the fluid pump.

As shown in FIG. 3, the fluid pump 100 may further include a mechanism or device for providing a retaining force against the first shift valve 140 when the first shift valve 140 is in each of two positions (the position shown in FIG. 1 and the position shown in FIG. 7). For example, the fluid pump 100 may include one or more detent mechanisms 192 that include a ball 194 that is urged against an outer surface of the elongated extension 188 of the first shift valve 140 by a spring member (not shown). As shown in FIG. 4, two or more recesses 196 (e.g., annular recesses, dimples, etc.) may be provided on the outer surface of the elongated extension 188 of the first shift valve 140. The two or more recesses 196 may be provided at different longitudinal positions along the elongated extension 188, one position corresponding to a position of the first shift valve 140 required for a rightward stroke of the drive shaft 116 (from the perspective of FIG. 1), and another position corresponding to a position of the first shift valve 140 required for a leftward stroke of the drive shaft 116. When a recess 196 is aligned with the ball 194, the ball 194 is urged into the recess 196. To move the first shift valve 140 to the left or right when the ball 194 is seated in a recess 196, the ball 194 may be urged out of the recess 196 against the biasing force of the spring that is forcing the ball 194 against the surface of the elongated extension 188 of the first shift valve 140. Thus, the detent mechanism 192 may be used to hold or retain the first shift valve 140 in one of the two respective positions used during a stroke of the drive shaft 116 until the first shift valve 140 is moved out of that position by the first flexible member 120 or one of the sealing attachment members 132.

The second shift valve 142 and associated recesses, conduits, seals, etc., may be configured similar to the first shift valve 140, but may be oriented in an opposite direction. From the perspective of FIG. 1, and as shown in FIGS. 2, 5, and 6, the second shift valve 142 may be oriented with an elongated extension 190 at the right side of the second shift valve 142. The elongated extension 190 may be located and configured such that at least one of the second flexible member 122 and a sealing attachment member 134 abuts against the end of the elongated extension 190 of the second shift valve 142 when the second flexible member 122 moves a certain distance to the left (from the perspective of FIG. 1).

The second cavity 154 may be substantially similar to the first cavity 152, but may be oriented in an opposite direction. Recesses 160*a*-160*e*, shown in FIG. 5, may be provided in a wall of the modular insert 144 (FIGS. 1 and 2) around the second cavity 154. The recesses 160*a*-160*e* may be annular in shape, and may be at least partially defined by the modular insert 144 and/or a sleeve 164. For example, recesses 160*a*-160*e* may be machined into the modular insert 144 before insertion of the sleeve 164. The sleeve 164 may define an inner boundary of one or more of the recesses 160*a*-160*e*. Each of the recesses 160*a*-160*e* may comprise a substantially continuous annular recess that extends around the sleeve 164. Thus, each of the recesses 160*a*-160*e* may be seen in the cross-sectional view of FIG. 5 over and under the sleeve 164 (from the perspective of FIG. 5). One or more of the recesses 160*a*-160*e* may be drive fluid passageways, and may be configured to direct a drive fluid to and from the second shift valve 142. Fluid conduits 168*a*-168*e* may lead through the modular insert 144 to one or more of the recesses 146*a*-146*c*, 160*a*-160*e*. The fluid conduits 168*a*-168*e* are shown as intersecting the plane of view in FIG. 5 to improve clarity of the functions and connections of the fluid conduits 168*a*-168*e*. However, the fluid conduits 168*a*-168*e* may be disposed in any position around the second shift valve 142. The fluid conduit 168*a* may connect recess 160*a* to recess 146*a*. Fluid conduit 168*b* may connect recess 160*b* to the first drive fluid chamber 127. Fluid conduit 168*c* may connect recess 160*c* to recess 146*b*. Fluid conduit 168*d* may connect recess 160*d* to an end of the first cavity 152 (FIG. 3). Fluid conduit 168*e* may connect recess 160*e* to recess 146*c*.

The sleeve 164 may be generally cylindrical or any other selected shape (e.g., having an oval cross section, a square cross section, etc.). The sleeve 164 may be secured within the second cavity 154 by an interference fit, by screws, or by any other attachment means. One or more holes 170 may be provided through the sleeve 164 in each plane transverse to the longitudinal axis of the second shift valve 142 that is aligned with one of the recesses 160*a*-160*e*. Thus, fluid communication may be provided between the interior of the sleeve 164 and each of the recesses 160*a*-160*e* through the holes 170. Furthermore, a plurality of sealing members 172

(e.g., O-rings) may be provided between the outer cylindrical surface of the sleeve 164 and the adjacent wall of the modular insert 144 within the bore in which the sleeve 164 is disposed, such as to eliminate fluid communication between any of the recesses 160*a*-160*e* through any space between the sleeve 164 and the modular insert 144. The second shift valve 142 may slide freely back and forth within the sleeve 164.

As shown in FIG. 6, the second shift valve 142 may comprise a first recess 176*a* in the outer surface of the second shift valve 142 and a second recess 176*b* in the outer surface of the second shift valve 142. The first recess 176*a* and the second recess 176*b* may be separated by a central ridge 180 on the outer surface of the second shift valve 142. Furthermore, a first end ridge 184*a* may be provided on the outer surface of the second shift valve 142 on a longitudinal side of the first recess 176*a* opposite the central ridge 180, and a second end ridge 184*b* may be provided on the outer surface of the second shift valve 142 on a longitudinal side of the second recess 176*b* opposite the central ridge 180.

Each of the first recess 176*a* and the second recess 176*b* may have a length (i.e., a dimension measured generally parallel to the longitudinal axis of the second shift valve 142) that is long enough to at least partially longitudinally overlap two adjacent recesses of the recesses 160*a*-160*e*. For example, when the second shift valve 142 is in the position shown in FIG. 5, the first recess 176*a* extends to and at least partially overlaps each of the recesses 160*d* and 160*e*, and the second recess 174*b* extends to and at least partially overlaps each of the recesses 160*b* and 160*c*. In this configuration, fluid communication is provided between the drive fluid source through the port 150*b* (FIG. 1) and the first drive fluid chamber 127 via conduits 148*b*, 168*b*, 168*c*, recesses 146*b*, 160*b*, 160*c*, 176*a*, and the holes 170 in the sleeve 164. Fluid communication is also provided between the port 150*c* (FIG. 1) and the end of the first cavity 152 via conduits 148*c*, 168*d*, 168*e*, recesses 146*c*, 160*d*, 160*e*, 174*b*, and the holes 170 in the sleeve 164. Furthermore, when the first shift valve 140 and the second shift valve 142 are in the positions shown in FIGS. 3 and 5, there is fluid communication between the drive fluid source through port 150*b* to the end of the second cavity 154. There is also fluid communication between the end of the first cavity 152 and the port 150*c*.

The fluid pump 100 may include a mechanism or device for providing a retaining force against the second shift valve 142, such as the detent mechanisms 192 described above. The second shift valve 142 may have two or more recesses 198 configured similar to the two or more recesses 196 of the first shift valve 140. The detent mechanism 192 may be used to hold or retain the second shift valve 142 in one of the two respective positions used during a stroke of the drive shaft 116 until the second shift valve 142 is moved out of that position by the second flexible member 122 or one of the sealing attachment members 134.

To facilitate a complete understanding of operation of the fluid pump 100, a complete pumping cycle of the fluid pump 100 (including a leftward stroke and a rightward stroke of the drive shaft 116, from the perspective of FIG. 1) is described below.

A cycle of the fluid pump 100 begins while the first shift valve 140 and the second shift valve 142 are in the positions shown in FIGS. 1, 2, 3, and 5. Upon movement of the first shift valve 140 into the position shown in FIGS. 1, 2, and 3, pressurized drive fluid passes from the port 150*b* into the conduit 148*b*, through the recess 146*b* to the conduits 166*c* and 168*c*. Drive fluid passes through the recesses 160*c*, 176*b*, and 160*b*, then through conduit 168*b* to the first drive fluid chamber 127 (see FIG. 5). The flow of drive fluid into the first drive fluid chamber 127 causes the first flexible member 120 to move and/or deform, decreasing the volume of the first subject fluid chamber 126. Subject fluid is thereby expelled from the first subject fluid chamber 126 through the subject fluid outlet 138. The drive shaft 116 exerts a leftward force and pulls the second flexible member 122, which causes the second flexible member 122 to move and/or deform, increasing the volume of the second subject fluid chamber 128. Subject fluid is thereby received into the second subject fluid chamber 128 through the subject fluid inlet 136. Drive fluid within the second drive fluid chamber 129 is exhausted through the conduit 166*d*, recesses 158*d*, 174*b*, 158*e*, conduit 166*e*, recess 146*c*, conduit 148*c*, and finally through port 150*c*.

Near the end of the leftward stroke, the fluid pump 100 is in the position shown in FIGS. 7 through 10. At least one of the second flexible member 122 and the sealing attachment member 134 abuts against the end of the elongated extension 190 of the second shift valve 142, and the second shift valve 142 is forced to the left (from the perspectives of FIGS. 7 through 10). This redistributes the flow of drive fluid around the second shift valve 142. As a result of the movement of the second shift valve 142, drive fluid passes through conduit 168*c*, recesses 160*c*, 176*a*, 160*d*, and conduit 168*d* to the end of the first cavity 152 (see FIGS. 9 and 10), pushing the first shift valve 140 to the left, to the position shown in FIGS. 7 through 9. The movement of the two shift valves 140, 142 to the left signals the end of a stroke of the drive shaft 116 and causes the drive shaft 116, the first flexible member 120, and the second flexible member 122 to begin moving to the right.

Figure 8:
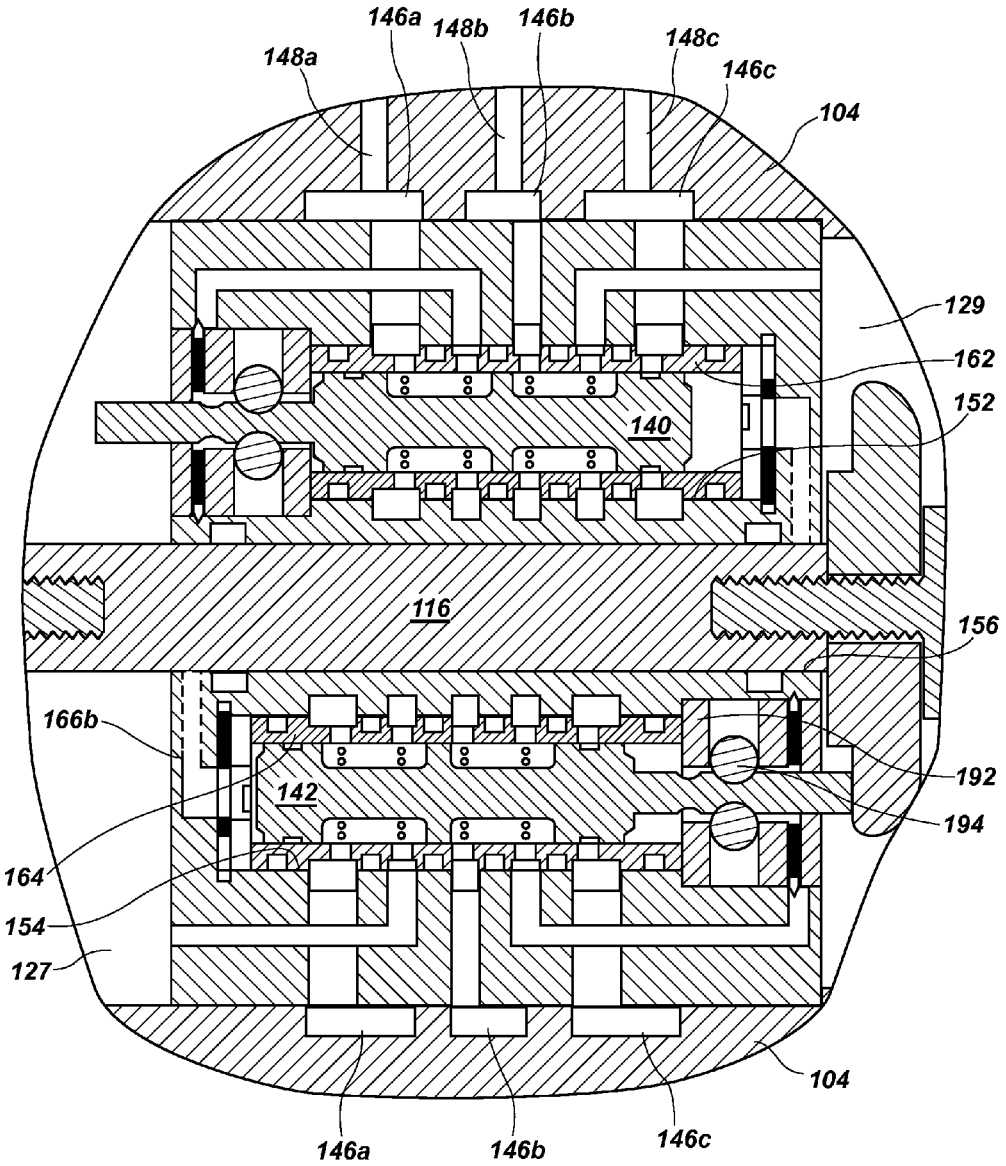
FIG. 8 is an enlarged view of a portion of the fluid pump in the position shown in FIG. 7.
Figure 9:
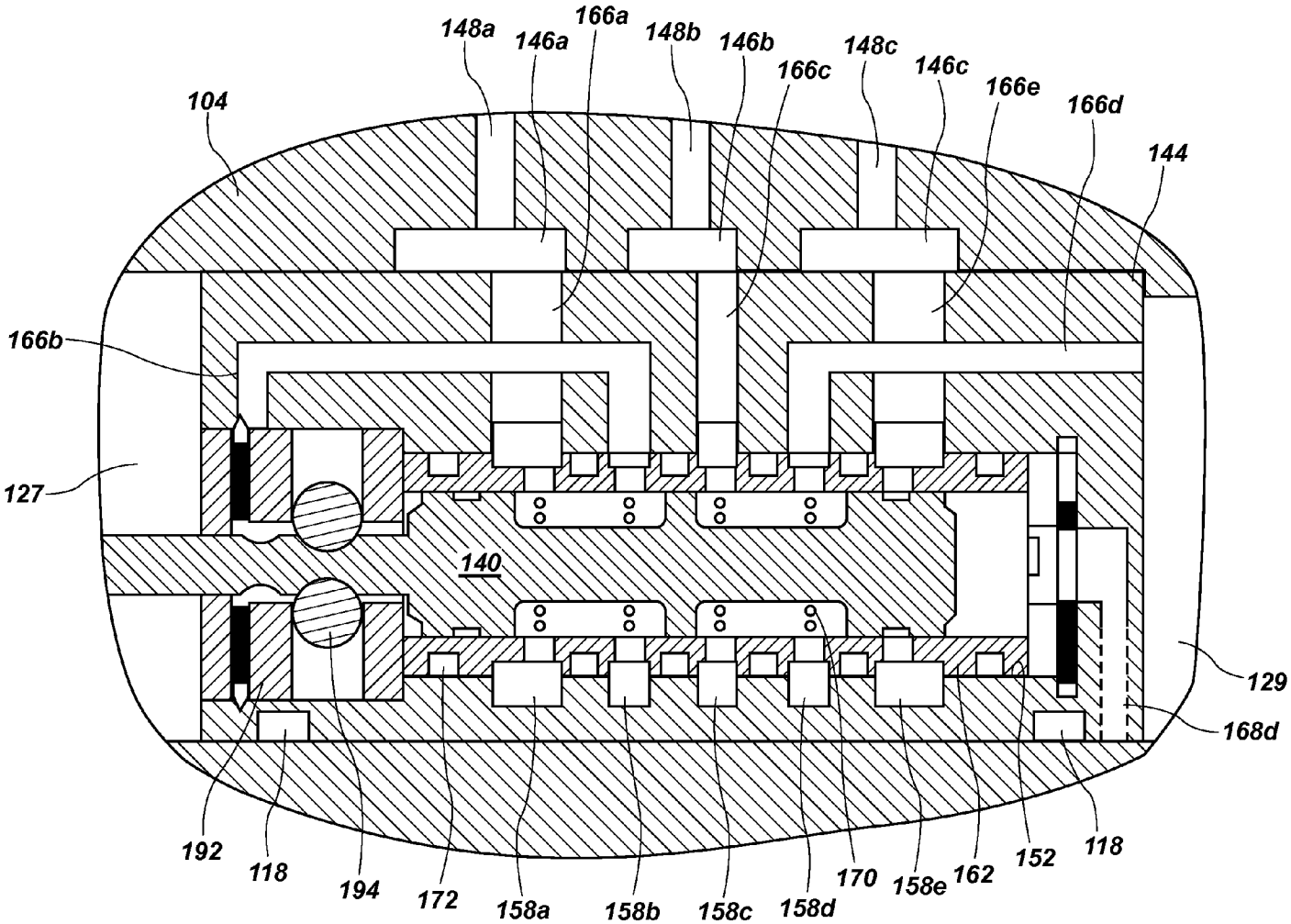
FIG. 9 is a further enlarged view of a portion of the fluid pump in the position shown in FIG. 7, including the first shift valve.
Figure 10:
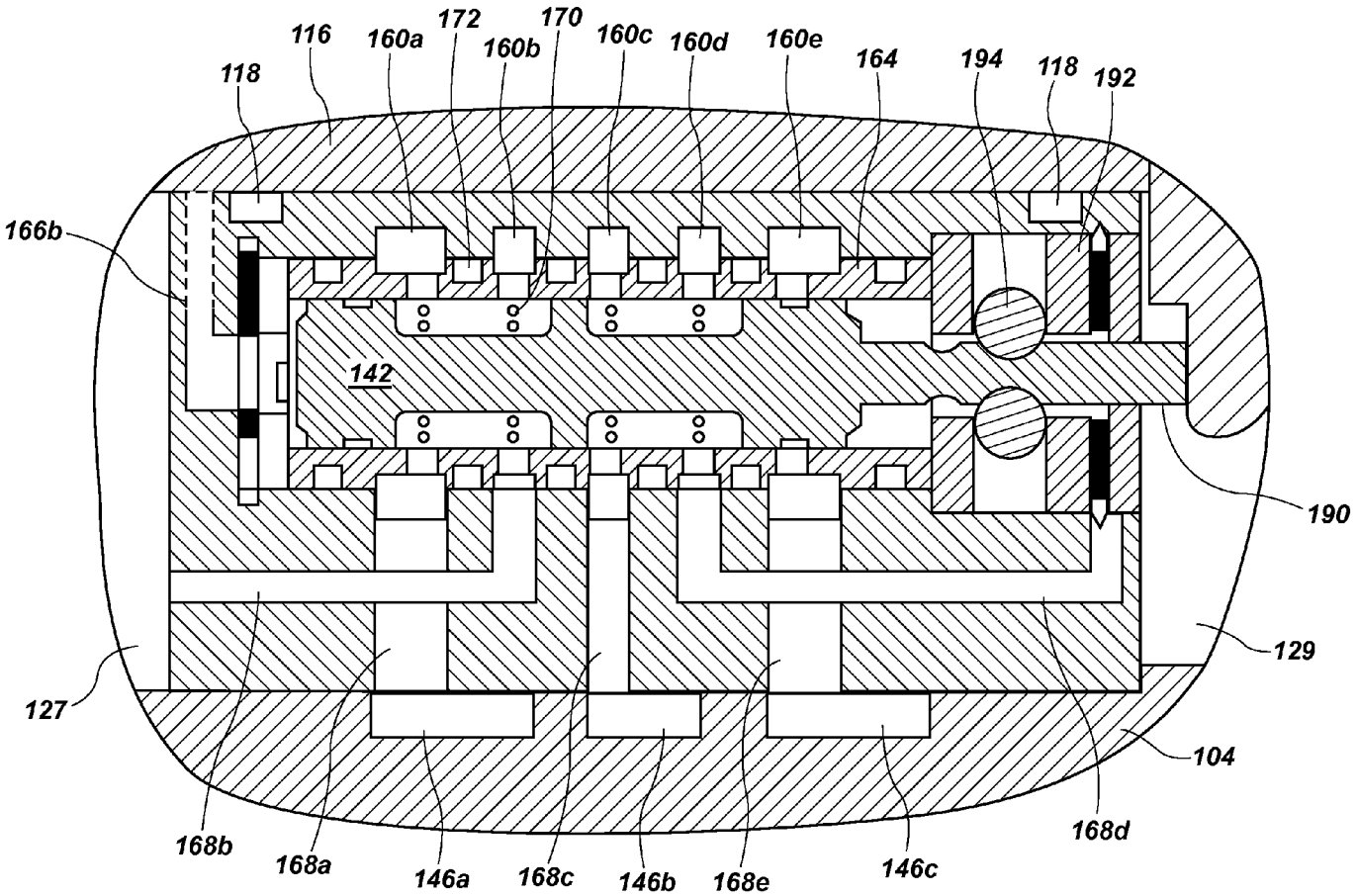
FIG. 10 is a further enlarged view of a portion of the fluid pump in the position shown in FIG. 7, including the second shift valve.

Upon movement of the second shift valve 142 into the position shown in FIGS. 7, 8, and 10, drive fluid passes through the recesses 158*c*, 174*b*, and 158*d*, then through conduit 166*d* to the second drive fluid chamber 129 (see FIG. 9). The flow of pressurized drive fluid into the second drive fluid chamber 129 causes the second flexible member 122 to deform, decreasing the volume of the second subject fluid chamber 128. Subject fluid is thereby expelled from the second subject fluid chamber 128 through the subject fluid outlet 138. The drive shaft 116 exerts a rightward force and pulls the first flexible member 120, which causes the first flexible member 120 to move and/or deform, increasing the volume of the first subject fluid chamber 126. Subject fluid is thereby received into the first subject fluid chamber 126 through the subject fluid inlet 136. Drive fluid within the first drive fluid chamber 127 is exhausted through the conduit 168*b*, recesses 160*b*, 176*b*, 160*a*, conduit 168*a*, recess 146*a*, conduit 148*a*, and finally through port 150*a*.

Near the end of the rightward stroke, the fluid pump 100 is again in the position shown in FIGS. 1, 2, 3, and 5. At least one of the first flexible member 120 and the sealing attachment member 132 abuts against the end of the elongated extension 188 of the first shift valve 140, and the first shift valve 140 is forced to the left (from the perspective of FIG. 1). This redistributes the flow of air around the first shift valve 140. As a result of the movement of the first shift valve 140, pressurized drive fluid passes through conduit 166*c*, recesses 158*c*, 174*a*, 158*b*, and conduit 166*b* to the end of the second cavity 154 (see FIGS. 3 and 5), pushing the second shift valve 142 to the right, to the position shown in FIGS. 1, 2, 3, and 5. The movement of the two shift valves 140, 142 to the right signals the end of a stroke of the drive shaft 116 and causes the drive shaft 116, the first flexible member 120, and the second flexible member 122 to begin moving to the left. The cycle of leftward movement of the drive shaft 116 followed by rightward movement of the drive shaft 116 repeats as long as the fluid pump 100 operates.

A method for manufacturing a fluid pump 100 may include dividing a first cavity 110 in a pump body 102 with a first flexible member 120 to define a first subject fluid chamber 126 and a first drive fluid chamber 127 within the first cavity 110. Similarly, the method may include dividing a second cavity 112 in the pump body 102 with a second flexible member 122 to define a second subject fluid chamber 128 and a second drive fluid chamber 129 within the second cavity 112. The first flexible member 120 and the second flexible member 122 may be connected with a drive shaft 116 extending at least partially through the pump body 102. A first shift valve 140 may be positioned within the pump body 102 between the first flexible member 120 and the second flexible member 122 beside the drive shaft 116. A second shift valve 142 may be positioned within the pump body 102 between the first flexible member 120 and the second flexible member 122 beside the drive shaft 116 and the first shift valve 140.

Figure 11:
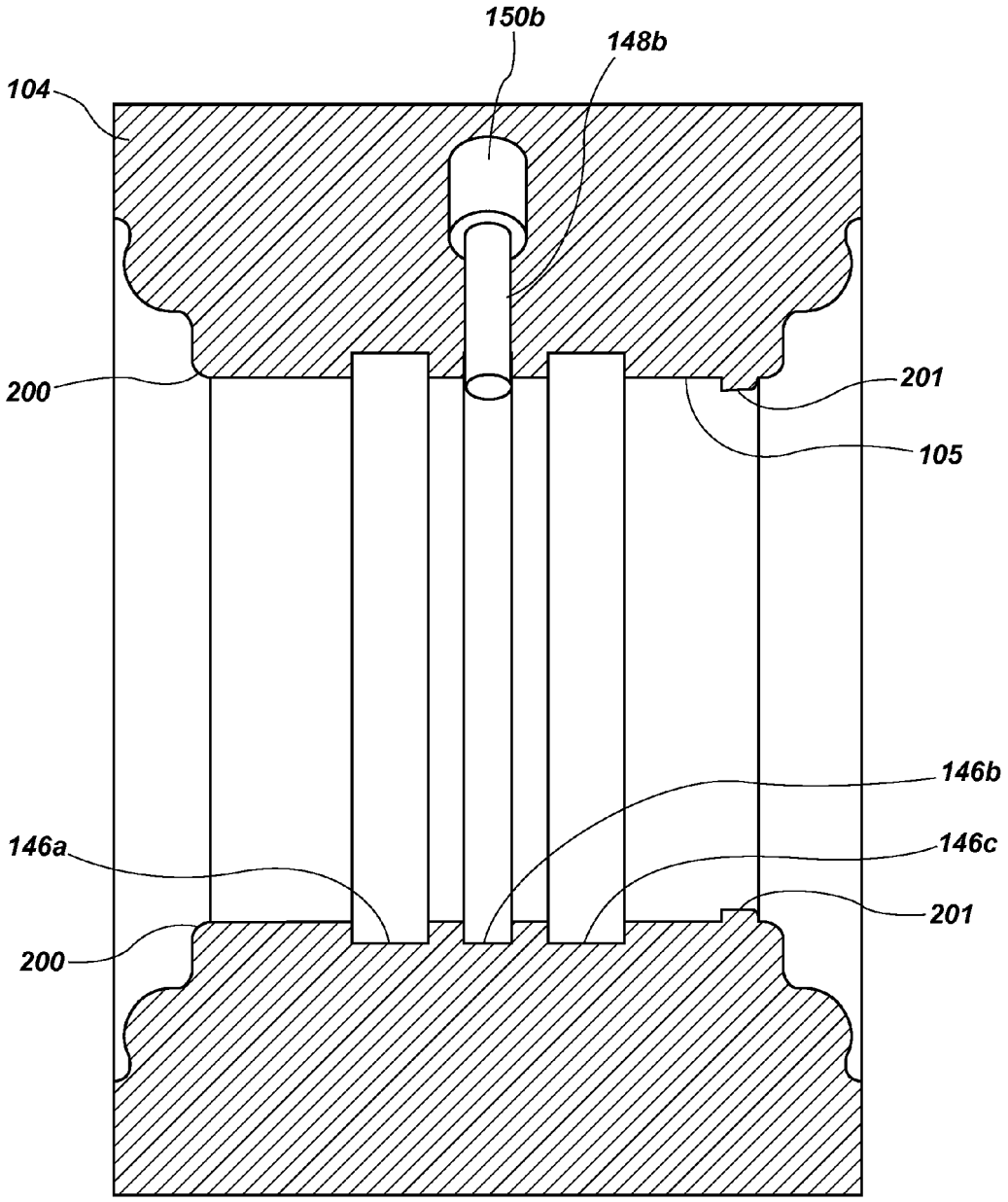
FIG. 11 is an enlarged view of a central body of the fluid pump of FIG. 1.
Figure 12:
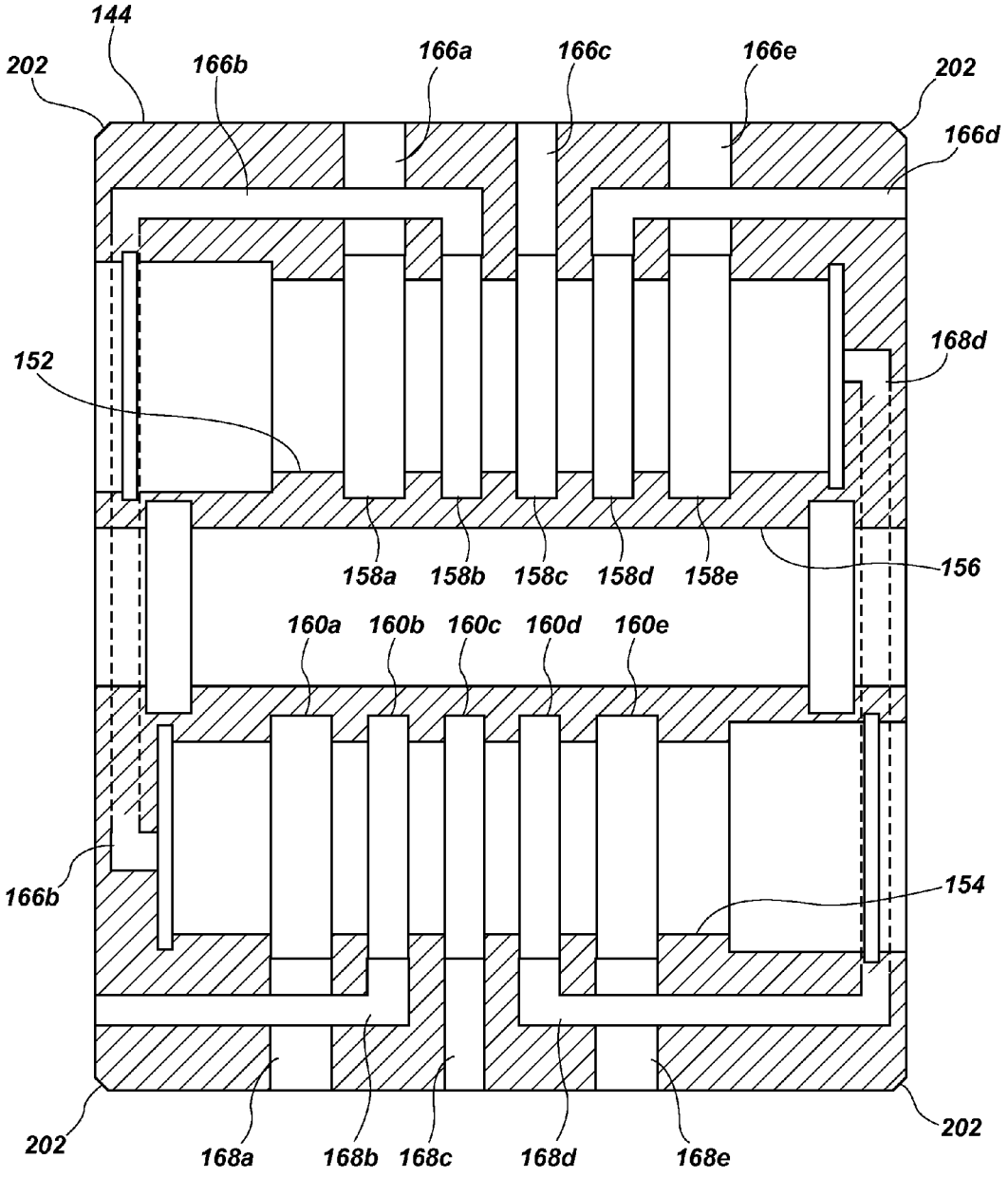
FIG. 12 is an enlarged view of an insert of the fluid pump of FIG. 1.

FIGS. 11 and 12 illustrate the central body 104 and the modular insert 144, respectively, of the fluid pump 100 of FIG. 1. As shown in FIG. 11, the central body 104 may have a central cavity 105 formed therein. The central cavity 105 may be generally cylindrical or any other selected shape, and may be formed by conventional methods (e.g., machining, casting, etc.). Recesses 146*a*-146*c* may be formed in the central body 104. Fluid conduit 148*b* and port 150*b* may be formed in the central body 104, as well as fluid conduits 148*a*, 148*c* (not shown in FIG. 11) and ports 150*a*, 150*c* (not shown in FIG. 11). The central cavity 105 may be a modular-receiving cavity (i.e., configured to receive a modular insert 144).

A modular insert 144 may be installed (as shown in FIG. 1) within the central body 104 by an interference fit. For example, the central cavity 105 of the central body 104 may be formed to have an inside diameter at a selected temperature $T_0$ (e.g., room temperature, a pump operating temperature, etc.) slightly smaller than an outside diameter of the modular insert 144. The central body 104 may be brought to a temperature $T_1$ higher than a temperature $T_2$ of a modular insert 144. Due to thermal expansion, the central cavity 105 of the central body 104 may have an inside diameter at $T_1$ larger than the outside diameter of the modular insert 144 at $T_2$. The modular insert 144 may slide into the central cavity 105 of the central body 104 without interference. As the temperatures of the modular insert 144 and the central body 104 equilibrate (e.g., toward $T_0$), the material of the modular insert 144 may expand, and/or the material of the central body 104 may contract. The modular insert 144 and/or the central body 104 may elastically deform as temperatures equilibrate. As a result, the interface between the modular insert 144 and the central body 104 may provide high friction, locking the modular insert 144 into the central cavity 105 of the central body 104.

For example, a nominal operating temperature $T_0$ of a pump may be from about 60° C. to about 200° C., such as from about 80° C. to about 100° C., or about 90° C. In an embodiment in which a central body 104 is formed of a metal or a metal alloy, the central body 104 may be heated to a temperature $T_1$ of at least about 300° C., at least about 500° C., or at least about 750° C. A modular insert 144 may be cooled to a temperature $T_2$ of less than about 0° C., less than about −40° C. or less than about −100° C. In an embodiment in which the central body 104 is formed of a polymer (e.g., polypropylene, polytetrafluoroethylene, etc.), the central body 104 may be heated to a temperature $T_1$ of at least about 60° C., at least about 90° C., or at least about 100° C. The modular insert 144 may be inserted into the central body 104 without any heating or cooling. In some embodiments, cooling of the modular insert 144 may be preferable to heating of the central body 104, because cooling may be less likely to change material properties (e.g., hardness) of components of the fluid pump 100.

In some embodiments, the modular insert 144 may be installed within the central cavity 105 of the central body 104 by force. For example, the modular insert 144 may be pressed with a hydraulic press into the central cavity 105 of the central body 104. The central cavity 105 of the central body 104 and/or the modular insert 144 may have chamfered or beveled edges 200, 202 (see also FIG. 12) to distribute the force evenly around the circumference of the central cavity 105, to allow compression to occur gradually, and/or to promote proper alignment of the modular insert 144 in the central cavity 105. A pressing force may be used instead of or in conjunction with the temperature differential described above. The central body 104 may include a lip 201 or a stop to aid in the proper alignment of the modular insert 144 in the central cavity 105. In other embodiments (not shown), the modular insert 144 include a lip or a stop to aid alignment.

Figure 13:
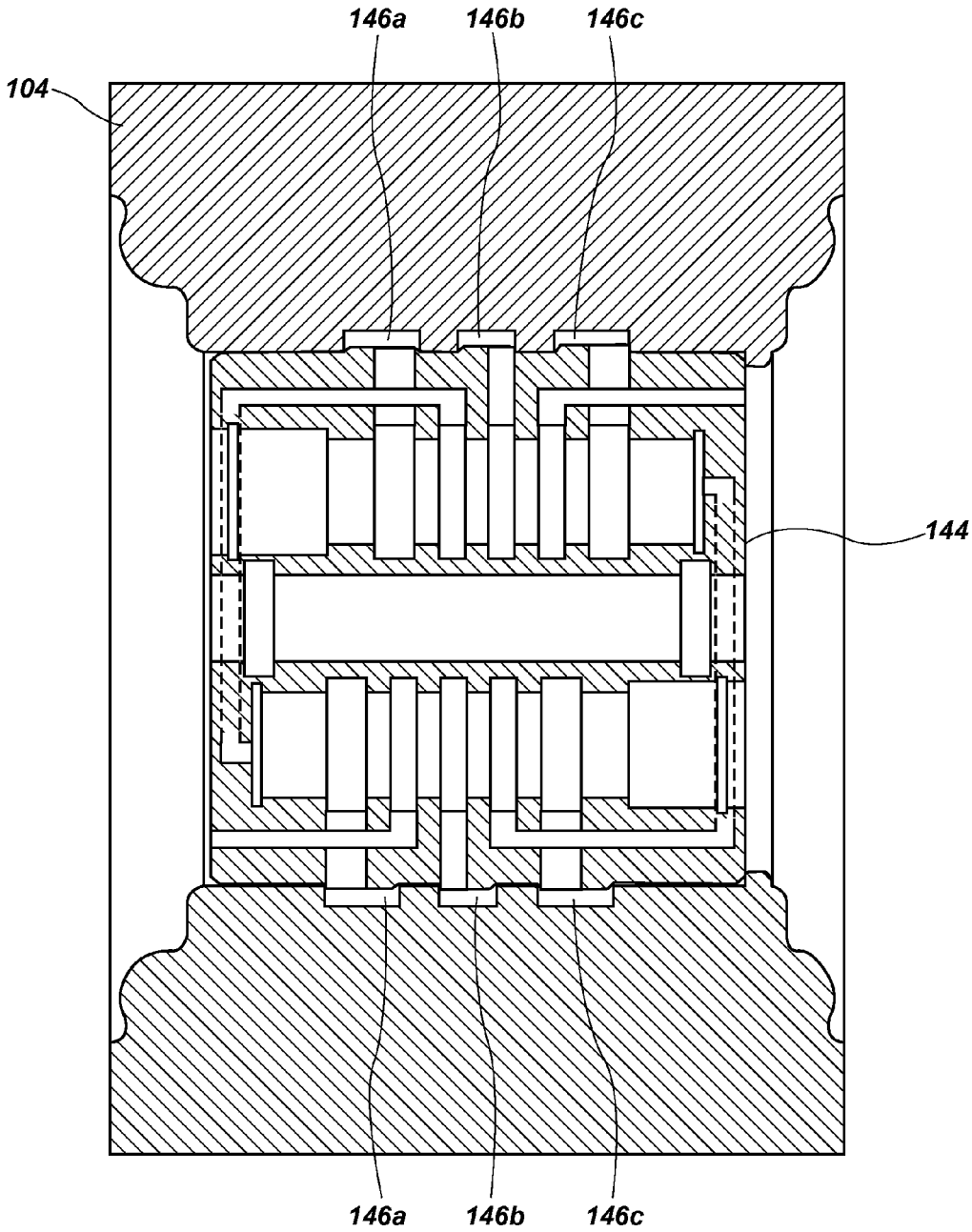
FIG. 13 is a simplified schematic showing how the insert of FIG. 12 may fit within the central body of FIG. 11.

FIG. 13 shows the modular insert 144 disposed within the central body 104, including an exaggerated representation of an interference fit. If the modular insert 144 is inserted in the central cavity 105 of the central body 104 while there is a temperature differential between the two bodies (e.g., while the central body 104 is at $T_1$ and the modular insert 144 is at $T_2$), followed by temperature equilibration, a portion of the modular insert 144 may expand to fill a portion of the cavities 146*a*-146*c* in the central body 104. Similarly, if the modular insert 144 is disposed within the central body 104 by a pressing force, a portion of the modular insert 144 may expand to fill a portion of the cavities 146*a*-146*c* as the insert is pushed into the central cavity 105. In other words, a portion of the modular insert 144 may "bulge" outward at a longitudinal location corresponding to the cavities 146*a*-146*c*. The bulged portion of the modular insert 144 may provide an additional locking mechanism (i.e., an interference). The magnitude of force required to remove the modular insert 144 may be larger than the magnitude of force required to remove a similarly sized insert from a central cavity 105 without cavities 146*a*-146*c*.

As shown in FIG. 12, the modular insert 144 may have cavities 152, 154, 156 formed therein. The cavities 152, 154, 156 may be generally cylindrical or any other selected shape (e.g., having an oval cross section, a square cross section, etc.), and may be formed by conventional methods (e.g., machining, casting, etc.). Recesses 158*a*-158*e*, 160*a*-160*e* may be formed in the modular insert 144. Fluid conduits 166*a*-166*e*, 168*a*-168*e* may be formed in the modular insert 144. Sleeves 162 and 164 (FIG. 2) may be secured in cavities 152 and 154, respectively, by an interference fit, as described above with respect to securing the modular insert 144 within the central body 104. For example, a difference in temperature and/or a pressing force may be used to facilitate insertion of the sleeves 162 and 164 within the cavities 152 and 154. The first shift valve 140, the second shift valve 142, and the drive shaft 116, may be slidingly disposed within the sleeve 162, the sleeve 164, and the cavity 156, respectively.

In some embodiments, the fluid pump 100 may be configured to pump a corrosive or reactive subject fluid, such as acid. In such embodiments, at least all components of the fluid pump 100 in contact with the subject fluid may be fabricated from or may have a coating of materials that are not corroded by, and do not react with, the subject fluid. For example, in embodiments in which the fluid pump 100 is configured to pump acid, at least the components of the fluid pump 100 in contact with the acid may comprise a polymer material (e.g., a thermoplastic or a thermosetting material). In some embodiments, such a polymer material may comprise a fluoropolymer. By way of example and not limitation, at least the components of the fluid pump 100 in contact with the acid may comprise one or more of neoprene, buna-N, ethylene propylene diene M-class (EPDM), VITON®, polyurethane, HYTREL®, SANTOPRENE®, fluorinated ethylene-propylene (FEP), perfluoroalkoxy fluorocarbon resin (PFA), ethylene-chlorotrifluoroethylene copolymer (ECTFE), ethylene-tetrafluoroethylene copolymer (ETFE), nylon, polyethylene, polyvinylidene fluoride (PVDF), polyvinyl chloride (PVC), NORDEL®, and nitrile.

While certain embodiments have been described and shown in the accompanying drawings, such embodiments are merely illustrative and not restrictive of the scope of the disclosure, and this disclosure is not limited to the specific constructions and arrangements shown and described, since various other additions and modifications to, and deletions from, the described embodiments will be apparent to one of ordinary skill in the art. Thus, the scope of the disclosure is only limited by the literal language, and legal equivalents, of the claims which follow.

What is claimed is:

1. A fluid pump, comprising:

a pump body including a first end body, a second end body, and a central body between the first end body and the second end body, the central body having a modular-receiving cavity therein;

a modular insert secured within the modular-receiving cavity by an interference fit, the central body of the pump body and the modular insert together defining at least a portion of at least one fluid passageway extending around the modular insert at an interface between the modular insert and the pump body;

a first fluid cavity and a second fluid cavity within the pump body;

a first flexible member disposed within the first fluid cavity and defining a first subject fluid chamber and a first drive fluid chamber within the first fluid cavity;

a second flexible member disposed within the second fluid cavity and defining a second subject fluid chamber and a second drive fluid chamber within the second fluid cavity;

a drive shaft attached to each of the first flexible member and the second flexible member and extending through the modular insert, the drive shaft configured to slide back and forth through the modular insert; and at least one shift valve disposed within the modular insert and configured to move in response to movement of at least one of the first flexible member and the second flexible member.

2. The fluid pump of claim 1, wherein the at least one shift valve comprises a first shift valve and a second shift valve operatively coupled to deliver a drive fluid to the first drive fluid chamber and the second drive fluid chamber in alternating sequence.

3. A fluid pump, comprising:

a pump body enclosing a first cavity and a second cavity, the pump body comprising:

a first end body;

an opposing second end body;

a central body between and coupled to the first end body and the second end body, the central body having at least one surface defining a modular-receiving cavity in the central body; and a modular insert disposed within the modular-receiving cavity in the central body, wherein a drive shaft, a first shift valve, and a second shift valve are disposed within the modular insert;

a first flexible member disposed within the first cavity and defining a first subject fluid chamber and a first drive fluid chamber within the first cavity;

a second flexible member disposed within the second cavity and defining a second subject fluid chamber and a second drive fluid chamber within the second cavity;

the drive shaft extending between and attached to each of the first flexible member and the second flexible member, the drive shaft configured to slide back and forth within the pump body;

the first shift valve disposed between the first flexible member and the second flexible member, the first shift valve configured to move in response to movement of the first flexible member; and the second shift valve disposed between the first flexible member and the second flexible member, the second shift valve configured to move in response to movement of the second flexible member;

wherein the first shift valve and the second shift valve are operatively coupled to deliver a drive fluid to the first drive fluid chamber and the second drive fluid chamber in alternating sequence.

4. The fluid pump of claim 3, wherein:

the first shift valve is moved from a first position to a second position thereof by a mechanical force when the drive shaft reaches an end of a stroke in a first direction, movement of the first shift valve from the first position to the second position thereof causing a pressure of the drive fluid to move the second shift valve from a second position to a first position thereof and switching delivery of the drive fluid from the second drive fluid chamber to the first drive fluid chamber; and the second shift valve is moved from the first position to the second position thereof by a mechanical force when the drive shaft reaches an end of a stroke in a second direction, movement of the second shift valve from the first position to the second position thereof causing the pressure of the drive fluid to move the first shift valve from the second position to the first position thereof and switching delivery of the drive fluid from the first drive fluid chamber to the second drive fluid chamber.

5. The fluid pump of claim 4, wherein each of a longitudinal axis of the first shift valve and a longitudinal axis of the second shift valve is oriented at least substantially parallel to a longitudinal axis of the drive shaft.

6. The fluid pump of claim 3, wherein each of the first shift valve and the second shift valve is disposed beside the drive shaft and within the pump body.

7. The fluid pump of claim 3, wherein at least one of the first flexible member and the second flexible member comprises a diaphragm.

8. The fluid pump of claim 3, wherein the modular insert is secured within the modular-receiving cavity by an interference fit with the central body.

9. The fluid pump of claim 3, wherein at least one of the pump body, the first flexible member, and the second flexible member comprises a fluoropolymer.

10. The fluid pump of claim 3, wherein the central body and the modular insert each define at least a portion of a plurality of drive fluid passageways surrounding the modular insert.

11. The fluid pump of claim 10, wherein the at least one surface defining the modular-receiving cavity in the central body has a plurality of recesses formed therein, and an outer surface of the modular insert has a plurality of protrusions therein, the plurality of protrusions extending partially into the plurality of recesses, the plurality of drive fluid passageways defined between the plurality of protrusions and the plurality of recesses.

12. The fluid pump of claim 3, wherein:

the modular insert has inner surfaces defining a first cavity, a second cavity, and a third cavity within the modular insert;

a first sleeve is disposed in the first cavity within the modular insert;

a second sleeve is disposed in the second cavity within the modular insert; and the drive shaft is disposed in the third cavity within the modular insert.

13. The fluid pump of claim 12, wherein:

the first shift valve is disposed within the first sleeve; and the second shift valve is disposed within the second sleeve.

14. The fluid pump of claim 12, wherein each of the first sleeve and the second sleeve is secured within the modular insert by an interference fit.

15. A method of manufacturing a fluid pump, comprising:

dividing a first cavity in a pump body with a first flexible member to define a first subject fluid chamber and a first drive fluid chamber within the first cavity;

dividing a second cavity in the pump body with a second flexible member to define a second subject fluid chamber and a second drive fluid chamber within the second cavity;

positioning a modular insert within a central body of the pump body;

positioning the central body between a first end body and a second end body of the pump body;

connecting the first flexible member and the second flexible member with a drive shaft extending at least partially through the modular insert within the central body of the pump body;

positioning a first shift valve within the modular insert within the central body of the pump body between the first flexible member and the second flexible member beside the drive shaft;

positioning a second shift valve within the modular insert within the central body of the pump body between the first flexible member and the second flexible member beside the drive shaft and the first shift valve;

configuring the first shift valve to move from a first position to a second position thereof responsive to a mechanical force when the drive shaft reaches an end of a stroke in a first direction, movement of the first shift valve from the first position to the second position thereof causing a pressure of a drive fluid to move the second shift valve from a second position to a first position thereof and switching delivery of the drive fluid from the second drive fluid chamber to the first drive fluid chamber; and configuring the second shift valve to move from the first position to the second position thereof responsive to a mechanical force when the drive shaft reaches an end of a stroke in a second direction, movement of the second shift valve from the first position to the second position thereof causing the pressure of the drive fluid to move the first shift valve from the second position to the first position thereof and switching delivery of the drive fluid from the first drive fluid chamber to the second drive fluid chamber.

16. The method of claim 15, further comprising orienting each of the first shift valve and the second shift valve such that a longitudinal axis of the first shift valve and a longitudinal axis of the second shift valve are oriented at least substantially parallel to a longitudinal axis of the drive shaft.

17. The method of claim 15, further comprising:

configuring at least one of the first flexible member and a first attachment member for attaching the first flexible member to the drive shaft to abut against and apply a mechanical force to the first shift valve to move the first shift valve from the first position to the second position thereof; and configuring at least one of the second flexible member and a second attachment member for attaching the second flexible member to the drive shaft to abut against and apply a mechanical force to the second shift valve to move the second shift valve from the first position to the second position thereof.

18. A method of manufacturing a fluid pump, comprising: forming a modular-receiving cavity within a central body of a housing; forming a plurality of recesses within the housing; disposing an insert within the modular-receiving cavity; disposing a drive shaft at least partially within the insert; disposing the central body between a first end body of the housing and a second end body of the housing; connecting a first flexible member and a second flexible member with the drive shaft; positioning a first shift valve within the insert between the first flexible member and the second flexible member beside the drive shaft; and positioning a second shift valve within the insert between the first flexible member and the second flexible member beside the drive shaft.

19. The method of claim 18, wherein disposing an insert within the modular-receiving cavity comprises securing the insert within the modular-receiving cavity by an interference fit.

20. The method of claim 18, further comprising forming a plurality of fluid passageways between the insert and an internal surface of the central body defining the modular-receiving cavity.

21. A method of pumping fluid, comprising:

moving a drive shaft, a first flexible member attached to a first end of the drive shaft, and a second flexible member attached to an opposite, second end of the drive shaft in a first direction in a pump body including a central body disposed between a first end body and a second, opposite end body to expel fluid from a first subject fluid chamber adjacent the first flexible member and draw fluid into a second subject fluid chamber adjacent the second flexible member, wherein the drive shaft is located at least partially within a modular insert within a cavity of the central body of the pump body;

moving a first shift valve located within the modular insert within the cavity of the central body of the pump body between the first flexible member and the second flexible member beside the drive shaft in response to movement of the second flexible member;

moving the drive shaft, the first flexible member, and the second flexible member in a second direction opposite the first direction to expel fluid from the second subject fluid chamber and draw fluid into the first subject fluid chamber; and moving a second shift valve located within the pump body between the first flexible member and the second flexible member beside the drive shaft in response to movement of the first flexible member.

22. The method of claim 21, wherein:

moving the second shift valve comprises abutting at least one of the first flexible member and a first sealing attachment member against the second shift valve; and moving the first shift valve comprises abutting at least one of the second flexible member and a second sealing attachment member against the first shift valve.

* * * * *